United States Patent [19]

Ruffino

[11] 4,372,067

[45] Feb. 8, 1983

[54] DEVICE FOR FILING MISCELLANEOUS ITEMS OF INFORMATION

[76] Inventor: Paule Ruffino, 32, rue Waldeck Rousseau, Lyon, France, 69006

[21] Appl. No.: 212,482

[22] Filed: Dec. 3, 1980

[30] Foreign Application Priority Data

Dec. 4, 1979 [FR] France ..... 79 30166

[51] Int. Cl.[3] ..... B42F 21/00

[52] U.S. Cl. ..... 40/360; 40/124.2; 40/536

[58] Field of Search ..... 40/124.2, 124.4, 373, 40/360, 404, 536

[56] References Cited

U.S. PATENT DOCUMENTS

| | | | |
|---|---|---|---|
| 930,488 | 8/1909 | Martineau | 40/360 |
| 1,548,487 | 8/1925 | Ross | 40/124.4 |
| 1,865,057 | 6/1932 | Hutchings | 40/373 |
| 1,899,453 | 2/1933 | Beers | 40/360 |
| 2,220,499 | 11/1940 | Thomas, Jr. | 281/2 |
| 2,226,976 | 12/1940 | Leaming | 129/20 |
| 2,747,894 | 5/1956 | Porter | 40/124.4 |

*Primary Examiner*—Gene Mancene
*Assistant Examiner*—Wenceslao J. Contreras
*Attorney, Agent, or Firm*—Pollock, Vande Sande & Priddy

[57] ABSTRACT

The invention relates to a device for filing miscellaneous information.

Said device comprises cards, each one comprising a notch on a vertical side, set back from the horizontal upper side, and a file which is provided with means for receiving the said cards, each means consisting of an aperture and a slit inclined towards the lower part of the support.

The device finds an application for the filing of flat supports such as sheets, cards or dockets.

12 Claims, 17 Drawing Figures

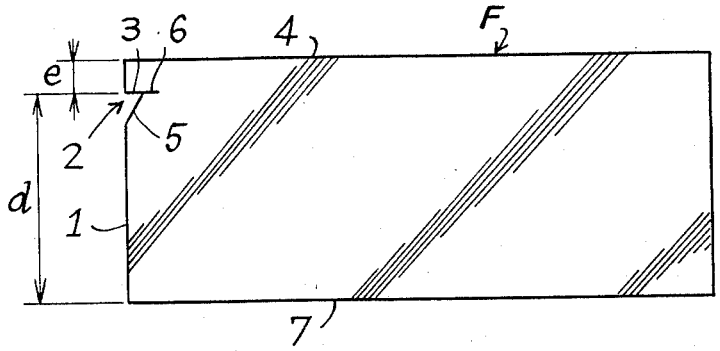
Fig. 1
Fig. 2
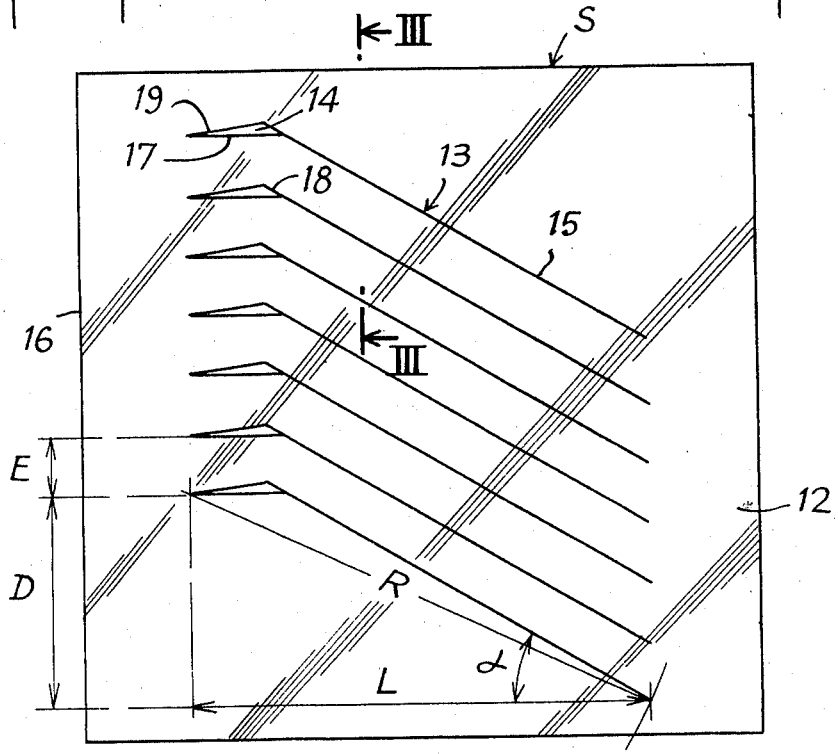
Fig. 3
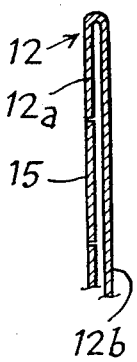
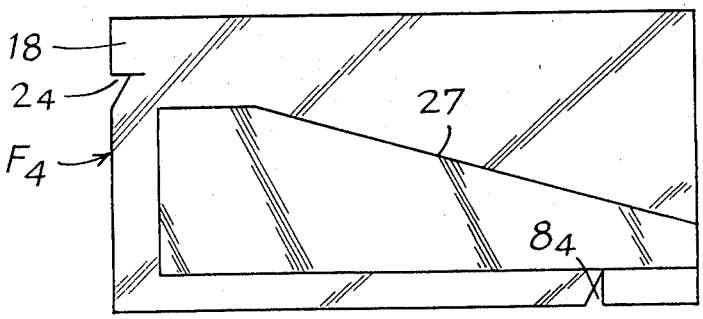
Fig. 17

F3
F2
V1
V2
V3
20
23
13
28
30
27
29
83
42
12
22
25
26
72
82
2
8
A
F
15
21

Fig-10
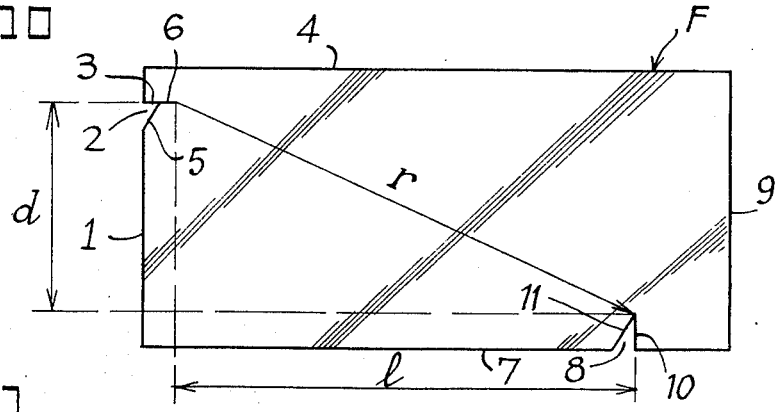
Fig-11
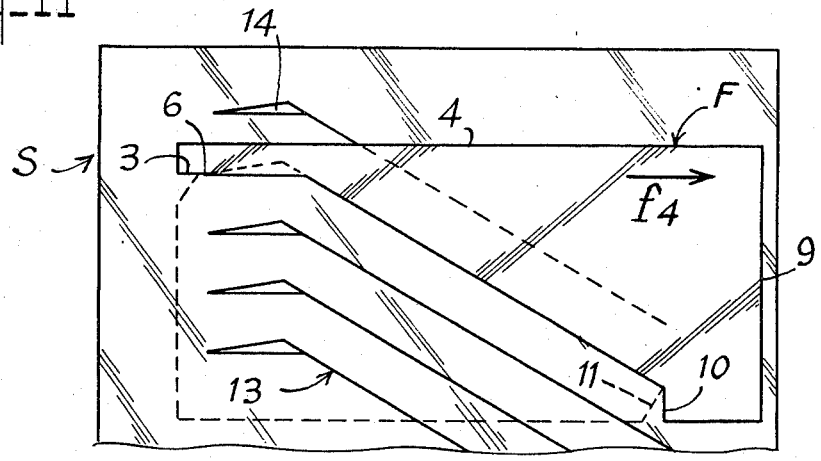
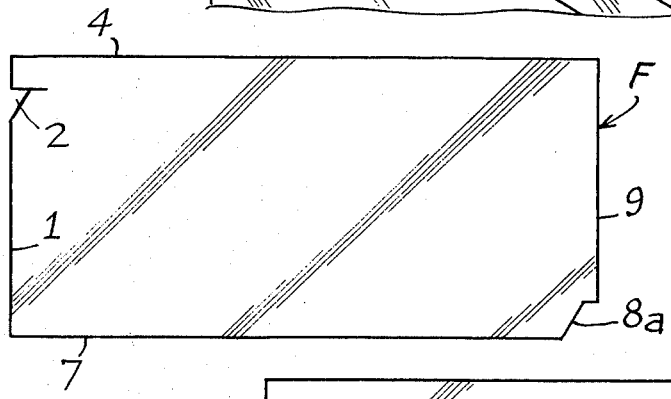
Fig-12
Fig-13
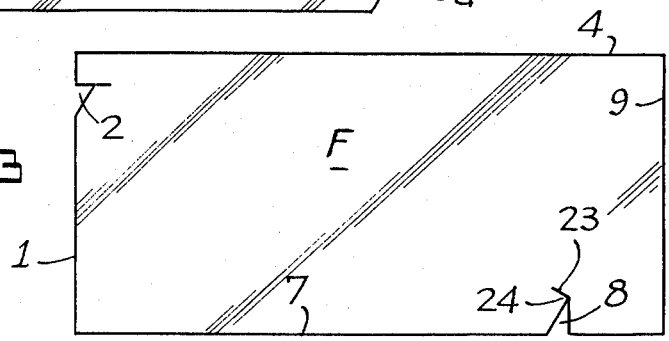

DEVICE FOR FILING MISCELLANEOUS ITEMS OF INFORMATION

TECHNICAL FIELD

The present invention relates to means of filing miscellaneous items of information of the direct read-out type carried by a movable support.

The technical field of the invention is that of the filing of cards constituted by flat supports such as sheets, cards, dockets, and the like.

BACKGROUND ART

In order to ensure the transmission and storage of miscellaneous items of information, representing reminders for different actions requiring to be performed at different intervals and, in a way, constituting a sequence of instructions, a manual, an analytical repertory, etc., it is known to use flat information-carrying media, generally made of paper, cardboard or the like. Such flat carriers may be simple sheets or cards on which the items of information to be stored are transcribed. Said carriers are qualified as loose and it is obvious that their use raises problems of filing, of storing and activation for users having no permanent and stable means of filing and indexing. Such movable supports are known for their inefficiency and are very often responsible for losses of transcribed information, which is quite the reverse of their initially intended purpose.

To overcome this drawback, it has also been proposed to constitute the movable carriers in the form of cards designed to be kept in box-shaped files in which the cards are stored edgewise to facilitate the searching, identifying and handling operations.

Although these systems are satisfactory on the whole, they have however a major disadvantage in that their use implies the existence of a filing container. This container makes the system difficult to use, especially whenever several cards have to be moved from a filing location to a processing location where they are actively used. Indeed, if the transfer can be ensured by means of a second container or file, it is obvious that this cannot be done when such cards need to be accompanied with processing files or when they need to be taken away to, for example, processing locations such as working sites.

Moreover, such cards of ordinary standard format generally offer no possibility for a synoptic visual filing, so that the retrieval of each momentarily active card raises, in every case, a problem which can only be solved with the addition of identification jumpers. Although such a method is feasible, it is quite obvious that it increases the cost of each card and implies a constant check of the jumpers to ascertain their position, their state, to check the risk of damage, etc.

Comparably, it has also been proposed to produce the movable information carriers in the form of T-shaped cards, i.e. cards comprising a shouldered upper area. Each of said cards is inserted in a slit provided in a support such as a display board. Such cards give an overall vision of the characteristic of a plurality of cards carried by a board, and offer as a result a better service than that given by the method described hereinabove. However, the drawback with these cards resides in the difficulty to file, use, store and index them when they need to be associated to a movable file or else when they are meant to constitute a memorandum or a reminder, being, for this intermediate or momentary purpose, retrieved from the said board and placed in the vicinity of the working station of an operator requiring information.

Moreover, the usable area of such cards is generally higher than wide so that the information to be stored raises first a problem of transcription then a reading problem.

And also, such T-shaped cards are not always easily accessible from their upper area when they are placed on a display support and the user often finds it difficult to insert or to retrieve one card with respect to a pack of cards.

It should also be mentioned that such cards naturally rest in vertical suspension on their shoulders and that there are no means locking them in position on display medium. Consequently, even assuming that a display medium can be portable, its use is practically impossible because of the moving out of sequence or misplacement invariably resulting therefrom, added to the risk of losing one or more cards.

DISCLOSURE OF THE INVENTION

It is the object of the present invention to overcome this drawback by proposing a filing device especially designed as a portable assembly where cards and supports are efficiently bound together so as to ensure a reliable and functional filing and a safe transport from a storage location to a geographically remote working location.

According to the invention, the miscellaneous information filing device, of the type comprising cards designed to be inserted into the receiving means of a support forming file, is characterized in that:

on the one hand, each card comprises on a vertical side and set back from the horizontal upper side, a notch extended by a cut or incision substantially parallel to the said upper side, and, on the other hand, each receiving means comprises:

a generally horizontal aperture, and a slit which extends from the said aperture with which it communicates, whilst being inclined towards the lower part of the support.

Amongst the advantages of the invention should be noted the large transcription surface offered by each card and how easy each one is to grip either for its retrieval from the support or for its insertion therein.

Another object of the invention resides in the fact that each card is provided with at least one directional locking means with respect to the support so that it is bound to the latter thereby facilitating manipulation without any risk of a card being lost or misplaced.

Yet another object of the invention resides in the fact that each filing card can be given a format which is a multiple of a basic format whilst retaining all the advantages offered by the invention. For example, the user can select the format most suitable to him depending on the amount of information he has to transcribe.

A last object resides in the fact that the production of the cards according to the invention only requires negligible trimming so that, for a given format, all the usable surface remains available for transcribing information.

BRIEF DESCRIPTION OF THE DRAWINGS

The invention will be more readily understood on reading the following description with reference to the accompanying drawings, in which:

FIG. 1 is a plan view of a card according to the invention.

FIG. 2 is a plan view of a file for the cards according to FIG. 1.

FIG. 3 is a partial cross-section along line III—III of FIG. 1.

FIGS. 8 and 9 are cross-sections showing a possible embodiment of one of the elements constituting the invention.

FIG. 10 is a plan view showing another embodiment of the card according to the invention.

FIG. 11 is a plan view illustrating the insertion of the card according to FIG. 10 into a file.

FIGS. 12 and 13 are two plan views illustrating two other variants of embodiment of the card.

FIGS. 14 to 17 are plan views illustrating different variants of embodiment of the invention.

BEST MODE FOR CARRYING OUT THE INVENTION

Figure 5:
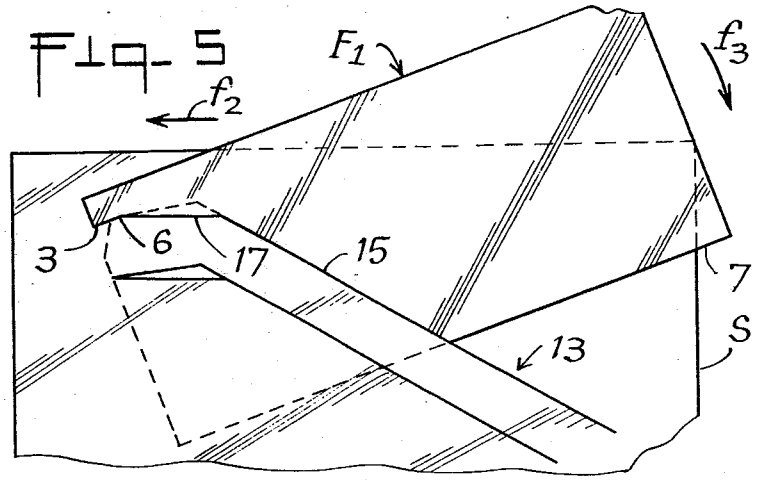
FIGS. 4 to 6 illustrate different phases of use of a card with respect to the file.

FIG. 1 shows a card according to the invention designated as a whole by the reference F. Said card F is constituted by a sheet of paper or similar material, which can be of rectangular overall shape for example. According to FIG. 1, the card F is placed, in the direction of use, so that its length is horizontally orientated. The dimensions of said card F may or may not correspond to a standard format and, in one practical example of embodiment, such a format can correspond to the ordinary format of bank checks.

The card F comprises, in one of its vertical sides, in the illustrated example the left side 1 considering the direction of use described hereinabove, a notch 2 which is defined by an edge 3 parallel to the horizontal upper side 4 and by an inclined edge 5 extending as far as the edge 3 towards the side 4. The notch 2 is completed by a slit or incision 6 which extends from the edge 3 over substantially the same length as said edge. The notch 2 is provided so as to be situated at a distance e from the horizontal side 4, which distance is selected to represent, at the minimum, a usable upper area for the legible recording of generic information to identify the card. For example, a suitable minimum distance e may be between 5 and 8 millimeters. It is however understood that the notch 2 could be situated at a considerably greater distance e from the side 4.

The device according to the invention further comprises a file designated as a whole by the reference S in FIG. 2. Said file S is composed of a plate, sheet, card or other rigid support 12 which can be made of any suitable material and be larger in size than the card F. The dimensions of the support 12 are determined in relation to the storing or filing capacity and of the system according to which the cards F are filed. According to FIG. 2, the support 12 is designed to support seven cards F disposed relatively according to a superimposed lay-out, but it is understood that provision may be made for another capacity of cards according to a different lay-out. To this effect, a support 12 may be used in which the cards are inserted in a single vertical column or even in parallel vertical columns.

For the filing and support of each card F, said support 12 comprises openable means 13 for insertion and retrieval of cards F. Each means 13 is provided with an aperture 14, which is generally horizontal, and connected to a slit 15 which extends obliquely towards the lower part of the support 12 starting from the said aperture 14. According to the Figure, this obliquity is shown to form an angle $\alpha$ equal to 60°. In the direction of use corresponding to the example illustrated in FIGS. 1 and 2, each means 13 is provided for a right-handed use and as such, the aperture 14 is situated adjacent the vertical side 16 on the left of the support 12 whereas the slit 15 extends obliquely towards the lower part on the right of said support. It should be noted that the aperture 14 and the slit 15 go right through the thickness of the support 12, so that the latter can equally be used by a left-handed person without the design having to be modified, but by simply subjecting it to a pivoting movement about the vertical side 16, in order to bring the apertures 14 adjacent the right edge and to orientate the slits 15 obliquely towards the lower part on the left depending on the direction of use.

Each aperture 14 is made by removing some of the material constituting the support 12 and to this effect it is prescribed to define the aperture by a substantially horizontal edge 17, by a first inclined edge 18 extending from the slit 15 and by a second inclined edge 19 joining the edge 18 to the end of the horizontal edge 17 opposite the slit 15.

FIG. 2 shows that each means 13 is provided in the support 12 so that there is, between the outmost edge of the aperture 14 and the opposite end of the slit 15, a length L which is smaller than the horizontal measurement of the card F. Provision is also made for each means 13 to have a vertical measurement D, comprised between the horizontal edge 17 of the aperture 14 and the end opposite the slit 15, which is equal to a measure d comprised between the edge 3 of the notch 2 and the lower side 7 of a card F. According to another arrangement of the invention, provision is also made to have, between superimposed means 13, a vertical distance E, between the horizontal edges 17 of two superimposed apertures, which distance is at least equal to the measure e comprised between the edge 3 of the notch 2 and the upper side 4 of the card F.

FIG. 3 shows that the support 12 can be constituted by a double sheet or plate so as to comprise a filing face 12*a* and a back 12*b* concealing on that level the apertures 14 and the slits 15.

Figure 4:
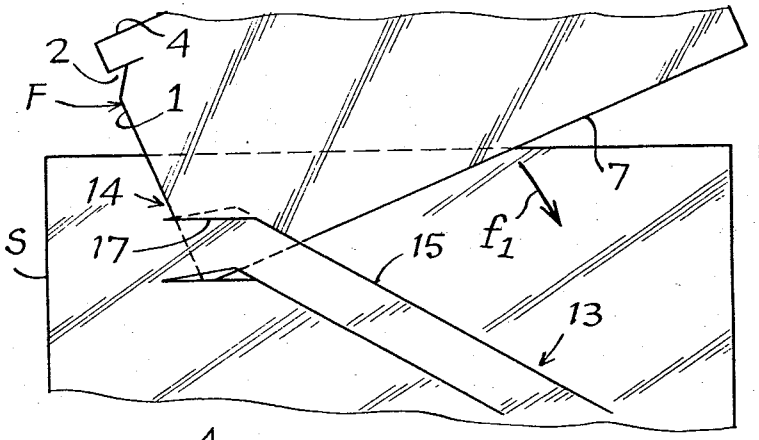
Figure 6:
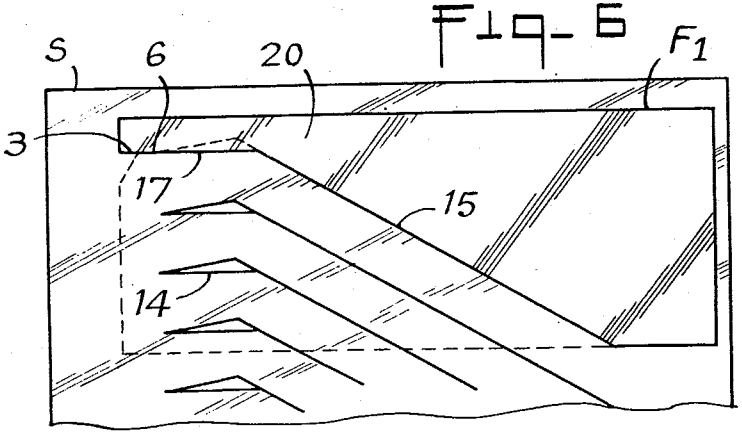

For a right-handed user, the card illustrated in FIG. 1 is used with the file illustrated in FIG. 2, as shown in FIG. 4, namely by inserting the lower lefthand corner of a card F, depending on the direction of use, in the aperture 14 of the selected means 13. The insertion of the card according to FIG. 4 is followed by a displacement of said card in the direction of arrow $f_1$, i.e. corresponding to a vertical displacement admitting an oblique component directed towards the right, so as to insert progressively the lower side 7 into the corresponding slit 15 at the same time as the side 1 into the aperture 14. Such an operation is carried out until the edge 3 of the notch 2 comes to a stop when level with the horizontal edge 17 of the aperture 14, keeping the card F always in an inclined position which is reversed to the inclination of the slit 15. In that position, illustrated in FIG. 5, the card F is subjected to a displacement in the direction of arrow $f_2$, so as to cause the lips of the incision 6 to overlap the corresponding end of the aperture 14, i.e. in the end angle formed by the edges 17 and 19. In this position, the card F is thereafter subjected to a pivoting movement in the direction of arrow $f_3$ on the joining point constituted by the overlapping of the incision 6 in the angle of the aperture 14, in order to complete the insertion of the card into the slit 15 until such time when the lower side 7 comes to rest on the lower end of the said slit 15, as illustrated in FIG. 6. In this position, the card F is kept horizontal by being locked in a stable position by means of the incision 6. Indeed, said incision 6 of the notch 2 opposes a relative vertical displacement upwards of the card F, and by the clamping exercised, it also prevents all risks of relative lateral movement towards the right with respect to the support 12. In this position, it must be noted that the card F has an upper area 20 which corresponds to its entire horizontal length, kept visible with respect to the support 12, so that said area can be used for writing or transcribing key details to identify the information recorded on the usable surface of the card F.

Figure 7:
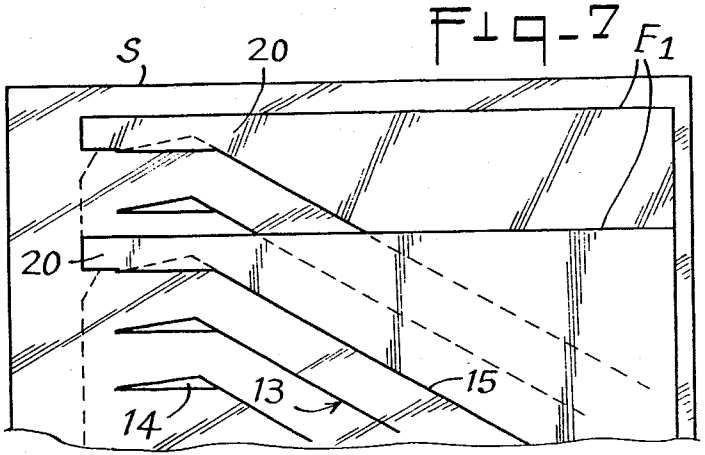
FIG. 7 is a plan view showing an advantage of the invention.

FIG. 7 shows that the measure E between the superimposed successive means 13 allows each one of the latter to be occupied by a card F, without each of these cards being entirely concealed in, and the area 20 of each one being always visible. This affords a constant display of the identification details without the user having to move any of the cards, except whenever he wishes to have access to the stored information, which, in this case, represents the processing phase of the card in question, said card being to this effect, retrieved from the support 12. Said retrieval phase is carried out by proceeding in reverse to what has been described hereinabove, so as to release the locking obtained with the notch 2 and allow the retrieval.

It should be noted that this operation is easily effected since the user has a maximum access to the right angle at the top of each card, as shown in FIG. 7.

As mentioned already, the means according to the invention permit equally to a right-handed user to use a card and a file, since the aforesaid operations can be conducted in a similar way by simply reversing the cards F and the support 12.

It should also be noted that the ratio of the distance E to the measurement e is such that the aperture 14 of a means 13 situated between two occupied means, is always visible. Thus, it is always possible, as illustrated in FIG. 7 to insert a card F as indicated above into an empty means 13 in the middle of a collection of cards inserted in a file S.

Figures 8, 9, 14, 15, 16:
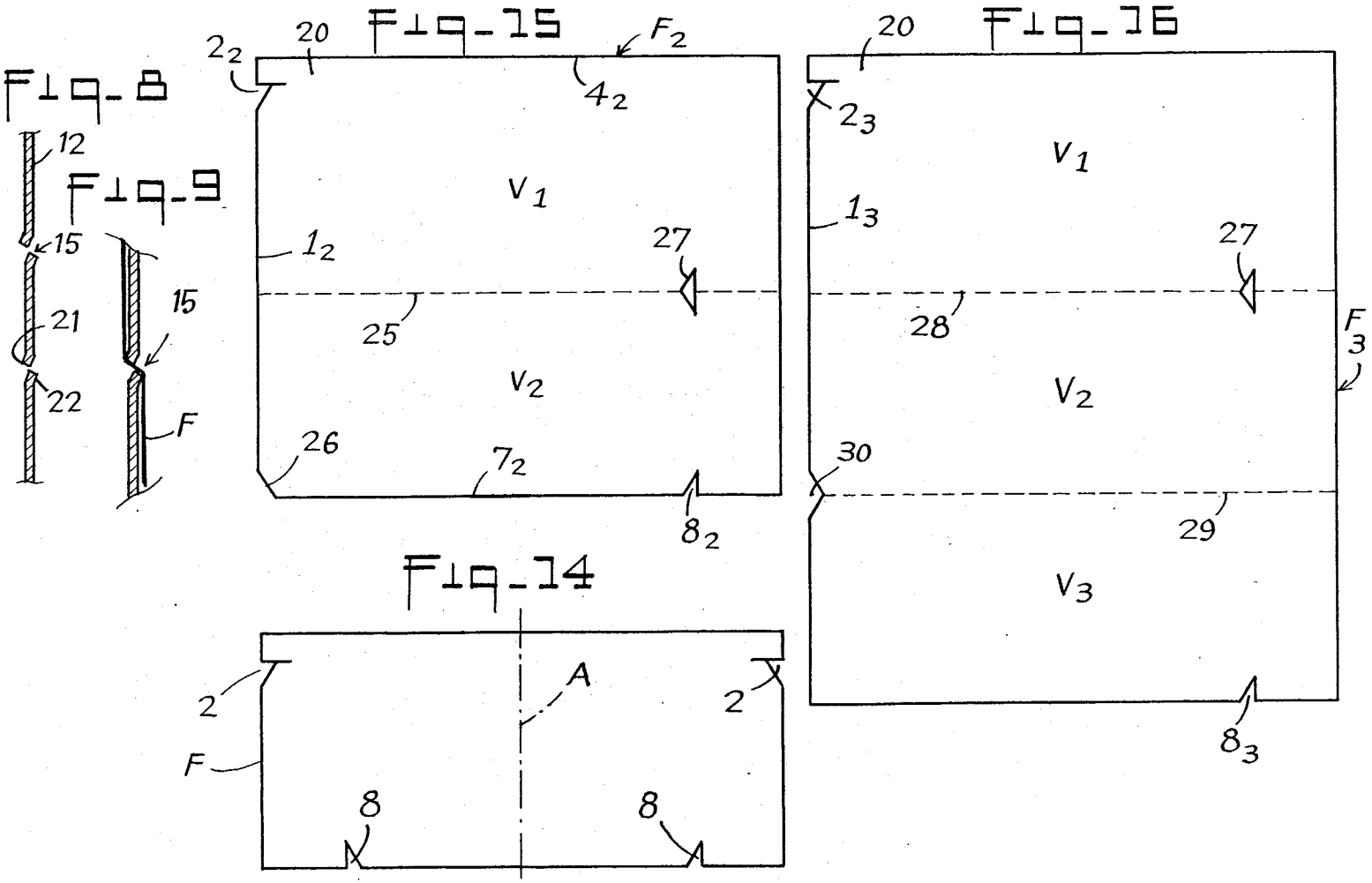

FIG. 8 shows, on a larger scale, that the support 12 can be designed so that the lips 21 and 22 defining each slit 15 are bent in opposite ways. Such bending can be produced by local deformation of the said lips, or by the means used to make the slit 15. The bendings 21 and 22 have the advantage, as shown in FIG. 9, of clamping each card F in a paarticular place thus helping to keep it efficiently in position, against any inadvertent movement, especially in the case of a portable support 12.

FIG. 10 shows a preferred embodiment of the invention wherein the card F comprises, in its lower horizontal side 7 and adjacent the lower corner opposite side 1, a notch 8 which is defined by an edge 10 parallel to the vertical side 9 and by an edge 11 which is inclined towards the edge 10 in the direction of the side 9.

The notch 8 is designed so that the end of the edge 10 is situated at a distance r from the end of the incision 6, which should be at least equal to the radius R centered on the end of the aperture 14 of a means 13 opposite the corresponding slit 15 and passing through the opposite end of the said slit. In the same way, the inclination of the edge 11 is selected so that the latter is recessed from the said radius R.

In the embodiment shown in FIG. 10, the notch 2 is provided in the vertical left side 1, whereas the notch 8 is provided adjacent the vertical right side 9. This corresponds to a direction of use given for a right-handed user as indicated above. But obviously the aforedescribed card F can be reversed by pivoting it on its vertical side 1, so that the latter is brought to the righthand side whereas the vertical side 9 is on the lefthand side. Such an orientation corresponding to a left-handed use as will be considered hereinafter.

The aforesaid embodiment ensures, as illustrated in FIG. 11, the fitting of the inclined edge 11 into the slit 15 the end of which is thus overlapped by the notch 8. As a result, the card F is locked positively against all relative lateral movement in the direction of arrow $f_4$ due to the presence of the inclined edge 11 which rests against the end of the slit 15.

It is possible with such an embodiment to obtain a pluri-directional locking of the card with respect to the support, i.e. firstly in downwards displacement through the edge 3 of the notch, secondly in lateral displacement leftwards according to the figure by the far end of the incision 6 and thirdly, in the direction of arrow $f_4$. It should also be noted that the incision 6 locks the card F in upward displacement.

In this kind of embodiment, the depth of the notch 8 is selected such as to leave a measurement d, as shown in FIGS. 1 and 2, in order to obtain the horizontality of a card F inserted in the file S.

FIG. 12 shows a variant of embodiment wherein the card F comprises a notch **8*a* provided in the lower angle opposite the vertical side which comprises the notch 2**. Such an embodiment can be considered whenever the length of the card, although greater, remains close to the length L.

FIG. 13 shows another variant of embodiment wherein the notch 8 is provided with an incision 23 made along the right line joining the end of the notch 8 to the far end of the notch 2. The incision 23 is shorter than the incision 6. In this way, after overlapping of the incision 6, when a card F is inserted, the pivoting movement permits to engage the edge 11 into the sit 15 until it rests on the far end of the notch 8. In this position, it suffices then to move the card F sideways in the direction of $f_4$ for the lips of the incision 23 to overlap the end of the slit 15. The movable small tongue 24 acts then as a lock which positively prevents the card F from pivoting in the reverse direction to arrow $f_3$, even if the file is dropped, for example.

The incision 23 can even be provided when there is a notch **8*a***.

FIG. 14 shows a variant of embodiment of the card F wherein said card is symmetrically shaped with respect to a vertical middle axis of symmetry A. The symmetrical shape concerns of course the notch 2 and the notch 8 which are then identical. Such a design permits the two-sided filing and support of each card, and is equally accessible to right-handed users.

FIG. 15 shows a variant of embodiment which is designed to give a larger storage surface than a simple card F. According to this particular variant, the card $F_2$ which can be termed double-card, is thus constituted by a sheet which, in addition to the area 20, has a vertical height which is twice the usable height of a card F between the edge 3 and the lower edge 7. The card $F_2$ has a folding line 25 which is shown to be parallel to the horizontal side $4_2$, so as to correspond to a materialization of the lower horizontal side 7 of the card F. The card $F_2$ is provided in the lower corner between the side $1_2$ and the lower horizontal side $7_2$, with a cut-out part 26 corresponding to the surface of the notch $2_2$.

Similarly, the card $F_2$ is provided, in alignment with the notch $8_2$ and on either side of the folding line 25, with an aperture 27 of shape and surface equal to two notches 8 opposed or joined by their fictitious bases.

The card $F_2$ is thus divided by the folding line 25 into two parts $V_1$ and $V_2$ which may be used on both faces for storing information. Prior to its insertion for filing, it suffices to mark the folding line 25 so as to fold the part $V_2$ over the back of the part $V_1$, thus transforming the aperture 27 into a notch 8 and bringing the cut-out part 26 to coincide exactly with the inclined edge of the notch $2_2$. The card $F_2$ can thus be inserted into a supporting means 13 as previously indicated with reference to FIGS. 4 to 6.

FIG. 16 illustrates a variant of embodiment wherein the card $F_3$ has a surface which permits to define, by means of two parallel folding lines 28 and 29, three parts $V_1$, $V_2$, $V_3$ of identical surface, the part $V_1$ being extended by the upper area 20. The aperture 27 is provided at the level of the folding line 24 separating the part $V_1$ from the part $V_2$, and, on either side of the folding line 29, from the vertical side $1_3$, there is provided a cut-out part 30 whose shape and surface corresponds to two notches 2 opposed by their edge 3.

The card $F_3$ has a storage capacity which is treble that of the card F and can nevertheless be inserted into a support means 13 of a file S by forming the folding lines 28 and 29 so as to successively fold the parts $V_3$ and $V_2$ on the back of the part $V_1$. After this particular folding operation, the aperture 27 becomes a notch 8 whereas the cut-out part 30 coincides exactly with the outline of the notch $2_3$, to allow, as previously described, the fitting and locking in an aperture 14 and in a slit 15.

Although this is not shown, it is understood that the embodiments illustrated in FIGS. 15 and 16 can be produced symmetrically with respect to a middle vertical line of symmetry A, as indicated with reference to FIG. 14.

It is obvious from the foregoing that the card and the file according to the invention are practical, simple and readily usable, the insertion and retrieval operations being effected rapidly and reliably. Moreover, each card, once inserted into the file, is locked in a stable position so that there is no risk of any inadvertent relative sliding.

A further advantage of the invention resides in the fact that the cards and the file can be produced to be used for stationary use or for portable use, in which case they are produced so as to be easily transportable, such as for example a standard design as $A_4$.

The cards F according to the present invention offer a large capacity of storage and can be included to the case file which they concern, at the end of use, or, if pending, they can be placed in a vertical file of the bill book type from which they can easily be retrieved whenever necessary.

In order to store momentarily pending cards, provision may be made, as illustrated in FIG. 17, for a card $F_4$ to comprise a pocket 31 inside which can be placed cards F. The card $F_4$ is preferably produced so as to show a greater mechanical resistance than the information-storage cards and, for example, said card may be produced from a sheet of rigid cardboard. In any case, the card $F_4$ is provided with the notch 2 and with the notch 8.

Considering the necessary displacement of the pocket 31 for the insertion of the cards F, the card $F_4$ has the peculiarity of having an upper area 20 whose height is equal to twice the measurement e of an information storage card F.

The invention is not limited to the examples of embodiments given hereinabove and various modifications may be made thereto without departing from the scope thereof.

What is claimed is:

1. Apparatus for filing miscellaneous items of information comprising:

a plurality of cards, each having a horizontal lower side, a vertical side and a horizontal upper side, a notch on said vertical side and set back from said upper side, said notch being extended by an incision substantially parallel to said upper side; and a support forming file having receiving means for cards said receiving means comprising a generally horizontal aperture means for engaging said notch and a slit extending from and communicating with said aperture means, said slit being inclined towards the lower part of said support forming file, whereby said notch on said vertical side of each card engages the outer edge of said horizontal aperture of its respective receiving means and said lower side of each card engages the lower end of said slit extending from said aperture, when each card is supported in said file.

2. Apparatus according to claim 1, wherein said notch comprises an edge parallel to said upper side, an edge inclined towards the said parallel edge in the direction of said upper side, and a slit in said card made from the innermost end of said notch and extending from said parallel edge over a length substantially equal to the horizontal width of said notch.

3. Apparatus according to claim 1 or 2, wherein each of said cards is provided with a lower side and adjacent the lower corner opposite said vertical side comprising said notch, each card comprises a further notch having an inclined edge positioned to engage the lower end of said slit of said support forming file.

4. Apparatus according to claim 1 or 2, wherein each card is provided with a lower side and in said lower side, with a further notch having at its upper end a slit substantially directed toward said notch on said vertical side.

5. Apparatus according to claim 1 or 2, wherein each card is provided with a folding line parallel to said horizontal side, thereby defining a lower part and an upper part, the height of said upper part being greater than that of said lower part by the distance between said horizontal upper side and a parallel edge of said notch on said vertical side; and wherein the corner of each card below said notch on said vertical side comprises a cut-out part symmetrical to said notch on said vertical side with respect to said folding line.

6. Apparatus according to claim 1 or 2, wherein each card is provided with two folding lines parallel to said horizontal side, thereby defining two lower parts of a first height and an upper part of a second height, said first height being less than said second height by the distance between said horizontal upper side and a parallel edge of said notch on said vertical side; and wherein said vertical side comprises a cut-out part situated in the axis of the folding line defining said two lower parts, said cut-out part being equal in shape and surface to two of said notches on said vertical side opposed by their parallel edge.

7. Apparatus according to claim 1 or 2, wherein cards are symmetrical with respect to a central vertical axis of symmetry.

8. Apparatus according to claim 3, wherein the length of said receiving means between the outermost edge of said aperture and the opposite edge of said slit extending from said aperture is equal to the distance on each card between the innermost end of said notch on said vertical side and an edge of said further notch which is parallel to the opposite vertical side of the card; the height of said receiving means between the lower edge of said aperture and the lower end of said slit extending from said aperture is equal to the vertical distance on each card, between an edge of said notch on said vertical side, said edge being parallel to the horizontal upper side, and the upper end of said further notch or said lower side; and the vertical distance between the lower edges of two adjacent apertures being at least equal to the distance from said notch on said vertical side to said horizontal upper side.

9. Apparatus according to claim 3, wherein each card is provided with a lower side and in said lower side, with a further notch having at its upper end a slit substantially directed toward said notch on said vertical side.

10. Apparatus according to claim 3, wherein each card is provided with a folding line parallel to said horizontal side, thereby defining a lower part and an upper part, the height of said upper part being greater than that of said lower part by the distance between said horizontal upper side and a parallel edge of said notch on said vertical side; and wherein the corner of each card below said notch on said vertical side comprises a cut-out part symmetrical to said notch on said vertical side with respect to said folding line, and said folding line is provided with a further aperture extending vertically above said further notch, which further aperture is equal in shape and surface to two such further notches joined by their base.

11. Apparatus according to claim 3, wherein each card is provided with two folding lines parallel to said horizontal side, thereby defining two lower parts of a first height and one upper part of a second height, said first height being less than said second height by the distance between said horizontal upper side and a parallel edge of said notch on said vertical side; and wherein said vertical side comprises a cut-out part situated in the axis of the folding line defining said two lower parts, said cut-out part being equal in shape and surface to two of sand notches on said vertical side opposed by their parallel edge, and wherein the folding line, separating said upper part from the adjacent lower part comprises, extending above said further notch, a further aperture which is equal in shape and surface to two such further notches joined by their base.

12. Apparatus according to claim 3, wherein said cards are symmetrical with respect to a central vertical axis of symmetry.

* * * * *